US005445232A

United States Patent [19]

Brännström et al.

[11] Patent Number: 5,445,232

[45] Date of Patent: Aug. 29, 1995

[54] HYDRAULIC BREAKING HAMMER

[75] Inventors: Östen Brännström, Saltsjö-Boo; Roland Henriksson, Nacka, both of Sweden

[73] Assignee: Atlas Copco Berema Aktiebolag, Nacka, Sweden

[21] Appl. No.: 313,307

[22] PCT Filed: Apr. 29, 1993

[86] PCT No.: PCT/SE93/00382

§ 371 Date: Oct. 5, 1994

§ 102(e) Date: Oct. 5, 1994

[87] PCT Pub. No.: WO93/22106

PCT Pub. Date: Nov. 11, 1993

[30] Foreign Application Priority Data

Apr. 29, 1992 [SE] Sweden ..... 9201340

[51] Int. Cl.[6] ..... E21B 10/00

[52] U.S. Cl. ..... 175/417; 173/100; 175/296

[58] Field of Search ..... 175/414–417, 175/296–298, 72; 173/100–107

[56] References Cited

U.S. PATENT DOCUMENTS 4,921,056 5/1990 Ennis ..... 175/296 X 4,932,483 6/1990 Rear ..... 175/296

*Primary Examiner*—Michael Powell Buiz

*Attorney, Agent, or Firm*—Mark P. Stone

[57] ABSTRACT

A hydraulic breaking hammer (10) has a machine housing (11) in which a percussion motor (15) which includes a reciprocatingly movable percussion piston (17) delivers impacts to a breaking tool (13) in the front of the machine housing (11). The machine housing (11) is carried by a surrounding carrier support (18) via intermediate walls (24, 25, 26). The carrier support has the form of a shell (18) which is attached at the rear adjacent connecting devices (19), to a carrier, such as a hydraulic digging machine which aligns the machine housing (11) while the manner (10) is at work. The machine housing (11) is constructed without joints in its axial direction along the length of the housing and includes a guide passage (21) in which a percussion motor (15) is carried, this percussion motor having the form of an insert cartridge which can be clamped from the rear. The shell (18), the intermediate walls (24, 25, 26) and the machine housing (11) are all combined in a single one-piece metal casting and the space between the shell (18) and the machine housing (11) is filled with a sound-damping material which adheres to the housing (11) and surrounding parts. Hydraulic fluid communication with the percussion motor cartridge (15) is effected through annular grooves (44', 45', 46') provided in the guide passage (21).

16 Claims, 3 Drawing Sheets

HYDRAULIC BREAKING HAMMER

Figure 1:
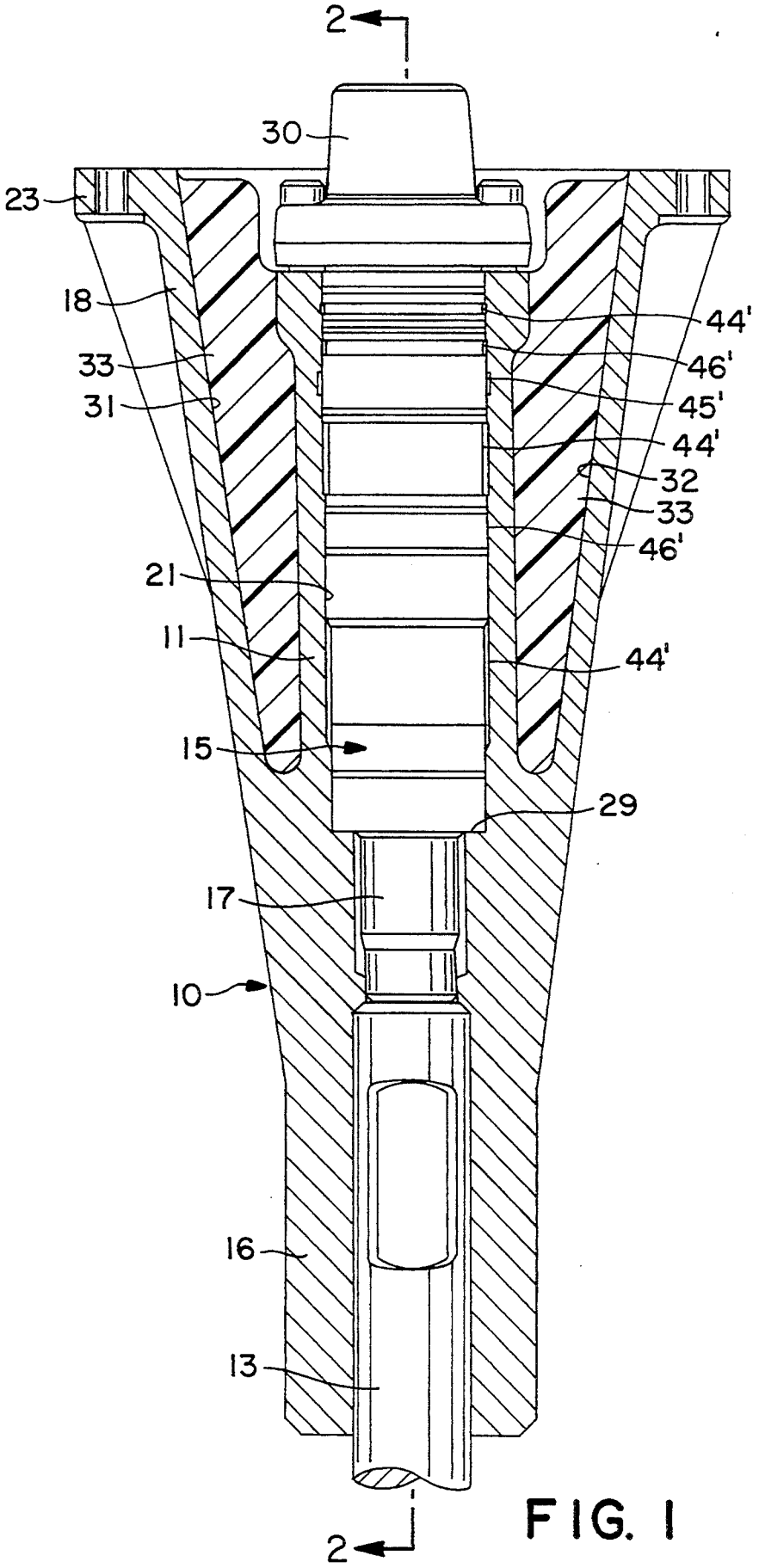

The present invention relates to a hydraulic breaking hammer comprising a machine housing in which a percussion motor includes a cylindrical part and a percussion or impact piston which moves reciprocatingly in the cylinder part and strikes against a breaking tool which is supported in a tool carrying portion at the front of the machine housing, said machine housing being supported inwardly of a surrounding carrier support device which is attached to connecting means which functions to bring the hammer mechanically into alignment during its work.

Breaking hammers of the type concerned are normally fitted to hydraulically operated excavating machines, or diggers, of different sizes, the hydraulic systems of which are switched so as to also drive the hammer, said hammer being connected to the outer end of the jib or boom of the digger through the medium of connecting devices, and said boom functioning to guide the hammer during a working operation.

The machine housing of the breaking hammer is typically comprised of separate cylinder parts, which surround the percussion piston, the seals and the valve system, and are grouped axially adjacent one another within the carrier support and held tightly together by strong side bolts, with the intention of obtaining a reliable seal between the cylinder parts against the high internal hydraulic working pressures that occur. The carrier support is normally comprised of metal plates held together by transverse bolts, or of casings between or in which the side-bolted cylinder parts are secured in some suitable fashion. The breaking hammer obtains a complicated machine housing construction in both instances, although the carrier support is required as a necessary outer protective means, since the hammer is handled harshly and may be subjected to repeated impacts against the work object. Examples of machine housings of the aforesaid configurations are described in U.S. Pat. Nos. 3,866,690 and 4,552,227.

The complicated breaking hammer construction has a negative influence on machine safety. Wear and corrosion together with micro-movements in the joints as a result of impacts and vibrations occurring as the hammer is used results in gradual penetration of working oil into the joints and their seals, which can result in oil leakages with subsequent danger to the surroundings and also in the risk of damage to the machine. The side bolts are also liable to fracture, with serious consequences.

In recent times, endeavours have been made to enhance machine safety by obviating the use of side bolts in sledge-mounted hydraulic drilling machines. U.S. Pat. No. 4,482,079 teaches an example of this concept. The considerably heavier work involving powerful functional and external impact stresses normally associated with hydraulic breaking hammers, for instance in concrete breaking, stone crushing and rock bursting operations in which machine and carrier weight together may reach to 3–9 tonnes, demands a mechanical strength which hitherto has been impossible to achieve conventionally with a breaking hammer and carrier support of acceptable handling weight with a starting point from the technology of drilling machines.

The object of the present invention is to transform the entire machine housing of a hydraulic breaking hammer of the type concerned to a simplified unit which is constructed integrally with its carrier support in a manner to combine a reasonable handling weight of the hammer with an impact durability which gives enhanced protection to the percussion motor and pressure oil channels of the hammer. At the same time, the integrally constructed machine housing provides improved sound damping around the jointless percussion motor of the machine housing in the interior of the carrier support. Another object is to enhance machine safety through the medium of said combination, by reduced risk of leakage since side bolts are no longer required, and by decreasing the separate elements included in the hammer, this latter also being advantageous with regard to maintenance, exchange of parts and storage. These objects are achieved with a hydraulic breaking hammer having the characteristic features set forth in the following claims.

Figure 2:
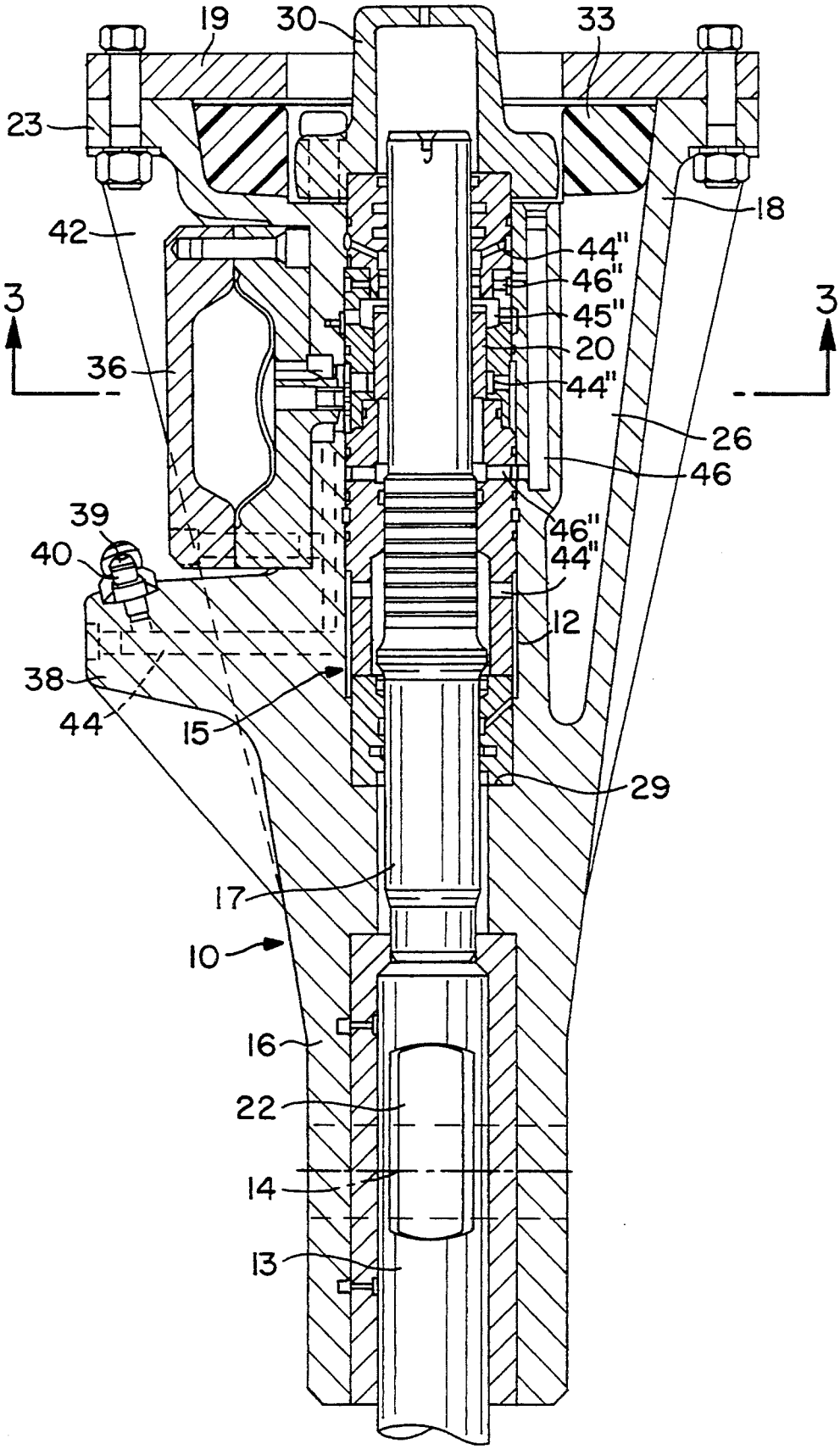
Figure 3:
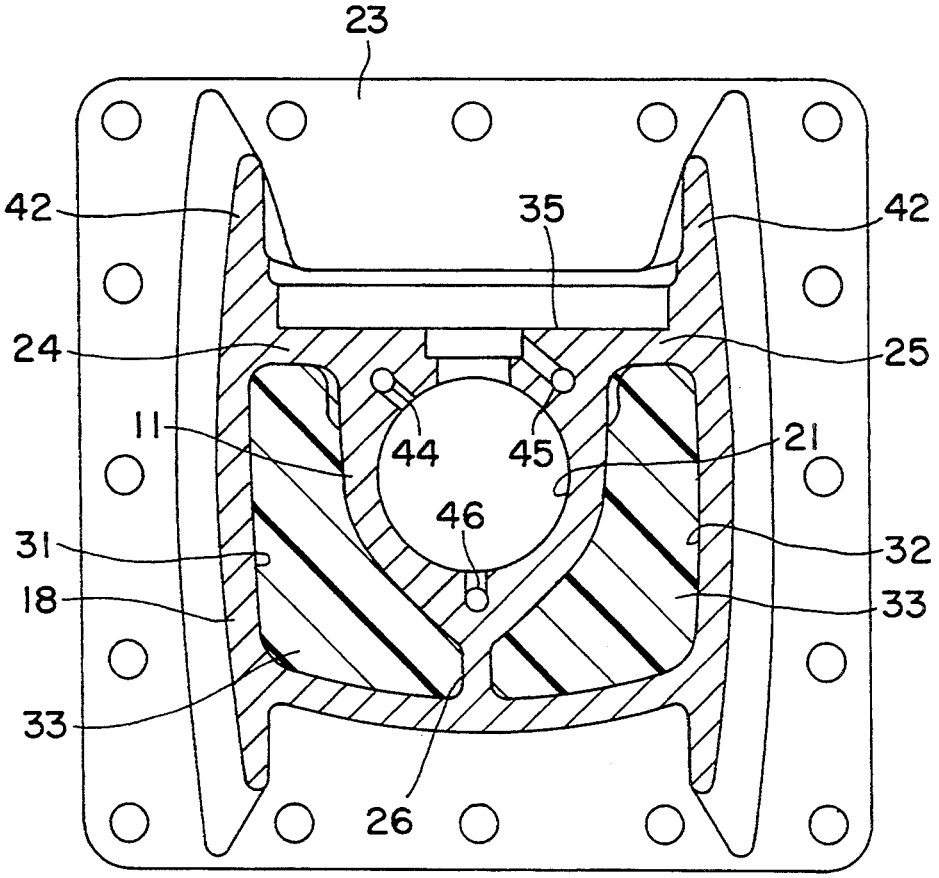

The invention will now be described in more detail with reference to the accompanying drawings. In the drawings, FIG. 1 is a longitudinal section view of an inventive breaking hammer and shows a non-sectioned percussion motor in the centre of the hammer;

FIG. 2 is a longitudinal section view taken on the line 2—2 in FIG. 1 with the percussion tool supported in the machine housing in the hammer interior in the form of a cartridge being shown in section; and FIG. 3 is a cross-sectional view taken on the line 3—3 in FIG. 2.

The illustrated breaking hammer 10 includes a machine housing 11 which has at the front of the housing a tool-receiving portion 16 which slidably carries a breaking tool 13 which is held in the hammer 10 for limited axial movement by means of transverse wedges 14, FIG. 2, which are shown schematically in broken lines and which coact with side recesses 22 in the tool 13. This wedge arrangement is described in more detail in Patent Specification SE 9203823-1. The machine housing 11 is surrounded by a carrier support 18, which in the case of the illustrated embodiment has the form of a shell 18 which extends from a reinforced part of the housing 11 from the tool-receiving portion 16 thereof while and widens in a bell-like fashion so as to be clear of the housing 11 and terminates at a schematically illustrated connector means 19, FIG. 3, behind said housing. Although not shown, the connector means 19 may include bearing lugs and forms part of the boom of a carrier, normally a digger, not shown in the Figures. The connector means 19 is attached to a rear end-flange 23 on the shell 18.

As shown in FIG. 2, two rearwardly extending and mutually adjacent stiffening intermediate walls 24, 25 are disposed between the shell 18 and the machine housing 11 while defining a side opening 35 which permits access to the housing 11 from the side. A third intermediate wall 26 is also preferably disposed on the opposite side of the housing 11, to increase stability. Depending on the number of intermediate walls 24–26 that are provided, either one or several rearwardly open cavities are formed within the shell 18. FIGS. 2 and 3 illustrate two cavities 31, 32 which are filled with a sound-damping material 33, preferably polyurethane, which adheres to surrounding walls and also to the machine housing 11 as a whole and functions to dampen sound generated by the breaking hammer 10. The machine housing 11, its tool-receiving portion 16, the shell 18 and the intermediate walls 24–26 have the form of a one-piece jointless structure made from cast metal, preferably cast iron, which provides the requisite mechanical strength at acceptable weight. The pointed configuration of the hammer 10 enables the hammer to work effectively and be positioned readily adjacent a rock or concrete wall for the purpose of demolishing and breaking-up the wall.

The intermediate walls 24, 25 form a bottom surface in the side opening 35, and a pressure accumulator 36, FIG. 2, is mounted firmly in a protected position on said bottom in the side opening 35, between stiffening flanges 42 on the shell 18. As further protection for the pressure accumulator 36 against impact forces, a horn structure 38 is provided on the machine housing 11 in front of the side opening 35. Disposed on the rear side of the horn 38 are connectors 39, 40 which function to conduct hydraulic fluid to and away from the percussion motor 15. The connectors 39, 40 are intended for connection to the hydraulic fluid system of the hammer carrier, for the purpose of operating the percussion motor 15. The percussion motor 15 has the form of an insert cartridge and is held firmly in a guide passage 21 in the machine housing 11 between a cover member 30, which is screwed to the rear wall of the housing 11 with screws 31, and an inner abutment 29 in the housing 11. The percussion motor 15 includes an impact or percussion piston 17 which moves reciprocatingly in a cylindrical part 12 which is divided axially in some suitable manner. Movement of the piston 17 is guided by a slide 20 which surrounds the rearward part of the piston. The guide passage 21 functions to transfer hydraulic fluid to and from the percussion motor 15, so as to ensure the function of said mechanism. To this end, the machine housing 11 is provided with axially extending channels 44–46 (FIG. 3), of which the channels 44 and 45 are each connected to a respective connector 39, 40 and open into a number of mutually sealed annular grooves 44', 45' distributed axially in the guide passage 21 in some suitable manner, FIG. 1. The channel 46 opens into two corresponding annular grooves 46' in the guide passage 21 and controls reversal of the direction of slide movement in accordance with movement of the piston 17.

The detail construction of the percussion motor 15 within the cartridge-like cylindrical part 12 of the percussion motor 15 may be of suitable, conventional design, provided that the cylinder part 12 is adapted to the annular channels 44'–46' of the guide passage 21 through the agency of coacting radially extending channels 44''–46'', FIG. 2, so as to ensure the repetitive hammer function of the percussion motor. The percussion motor 15 is a constructive modification of the embodiment illustrated in U.S. Pat. No. 4,676,323, which also describes the aforesaid pressure accumulator 36 in more detail. The piston 17 is thus constantly under pressure, via the radial channel 44'', and the diameter relationships are such that the piston will be subjected constantly to fluid pressure in a rearward direction and at the end of its rearward movement from the illustrated position will strike the slide 20 and reverse movement of the slide to a rearward movement. As a result, pressurized hydraulic fluid will enter through the radial channel 44'', causing the piston 17 to execute a forward working stroke. Before reaching the impact position shown in FIG. 2, the direction of movement of the slide is reversed from a rearward direction to a forward direction via the impact piston 17 and through the action of the channel 46. This movement reversal sequence is also conventional and is described in more detail, for instance, in U.S. Pat. No. 3,766,830 and will not therefore be described in more detail here.

When the invention is applied to a carrier support that has the form of parallel side plates instead of a surrounding shell, the side plates, intermediate walls and machine housing are also in the form of a single-piece metal structure. The sound-damping material is adhered to the machine housing, around the percussion motor, the intermediate walls and the inner surfaces of the side plates.

The provision of sound-damping material 33 in the cavities 31, 32 in accordance with the invention has resulted in a sound reduction in the order of 5 decibels and the application of damping material in the interior of the shell 18 forming the carrier support has been found to provide a good sound-damping effect also with regard to the damping of sound generated by the free outer surfaces of the carrier support, it being undesirable to cover these surfaces with sound-damping material due to the harsh working conditions.

We claim:

1. A hydraulic breaking hammer (10) comprising a machine housing (11), in which a percussion motor (15) includes a cylinder part (12) and a percussion piston (17) which is reciprocatingly movable in the cylinder part (12) and which delivers blows to a breaking tool (13) supported in a tool-receiving portion (16) at the front of the housing (11), wherein the housing (11) is carried by a surrounding carrier support (18) which is attached to a connector means (19) for guiding the hammer (10) mechanically during its work, characterized in that the machine housing (11) is undivided in its axial direction and interiourly in a guide passage (21) of the housing, without the support of side bolts, carries the cylinder part (12) of the percussion motor (15) fixed axially in said guide passage (21) between an inner abutment (29) adjacent the tool-receiving portion (16) of the housing and a cover member (30) attached to the rear end of the housing; in that the machine housing (11) merges with the carrier support (18) via stiffening intermediate walls (24, 25); and in that the carrier support (18), the intermediate walls (24, 25) and the machine housing (11) are incorporated in a single one-piece metal structure.

2. A breaking hammer according to claim 1, characterized in that the space between the carrier support (18) and the machine housing (11) is filled with a sound-damping material (33) which is adhered to said parts along the full length of the housing (11).

3. A breaking hammer according to claim 1, characterized in that the machine housing (11) includes the tool-receiving portion (16) and extends integrally with said tool-receiving portion rearwardly to the region of connecting means (19) free from said means; in that the carrier support (18) forms a shell (18) which extends from the machine housing (11) rearwardly of the tool-receiving portion (6) and as protection for the housing (11) widens in a bell-like manner rearwardly around said housing and terminates at the connecting means (19) while forming one or more rearwardly open cavities (31, 32) located between the shell (18) and the machine housing (11) and defined by the intermediate walls (24–26).

4. A breaking hammer according to claim 3, characterized in that the machine housing (11), the tool-receiving portion (16), the carrier support (18) and the intermediate walls (24–26) are all included in a jointless one-piece cast metal structure.

5. A breaking hammer according to claim 3, characterized in that the cavities (31, 32) between the machine housing (11), the intermediate walls (24–26) and the carrier support (18) are filled with a sound-damping material (33) which adheres to said parts.

6. A breaking hammer according to claim 1, characterized in that the carrier support (18) exposes a side opening (35) to the machine housing (11) between two mutually opposing intermediate walls (24, 26), in which opening (35) a pressure accumulator (36) coacting with the percussion motor (15) can be mounted.

7. A breaking hammer according to claim 6, characterized in that an impact-repelling horn structure (38) is provided on the machine housing (11) between the tool attachment (16) and the side opening (35), said horn structure functioning to protect the pressure accumulator (36) mounted in the side opening (35) and also to protect connectors (39, 40) through which hydraulic fluid is conveyed to and from the percussion motor (15) in the machine housing (11).

8. A breaking hammer according to claim 6, characterized in that the side opening (35) is defined laterally by outwardly projecting flanges (42, 43) which extend in the longitudinal direction of the hammer (10), outwardly of the opposing intermediate walls (24, 26).

9. A breaking hammer according to claim 1, characterized in that the machine housing (11) includes axially extending channels (44–46) around the percussion motor (15), of which channels two (44, 45) are connected to connectors (39, 40) on the machine housing (11) for conducting hydraulic fluid to and from the percussion motor (15), and a third (46) of said channels functions to control the percussion motor (15); and in that the channels (44–46) are placed in hydraulic fluid connection with the percussion motor (15) such as to ensure a repetitive hammering sequence, through the medium of annular grooves (44′–46′) mutually grouped axially and mutually sealed in the guide passage (21), and radially extending channels (44″–46″) provided in the cylinder part (12) of the percussion motor (15) and connecting with said annular grooves (44′–46′).

10. A breaking hammer according to claim 4, characterized in that the cavities (31, 32) between the machine housing (11), the intermediate walls (24–26) and the carrier support (18) are filled with a sound-damping material (33) which adheres to said parts.

11. A breaking hammer according to claim 2, characterized in that the carrier support (18) exposes a side opening (35) to the machine housing (11) between two mutually opposing intermediate walls (24, 26), in which opening (35) a pressure accumulator (36) coacting with the percussion motor (15) can be mounted.

12. A breaking hammer according to claim 3, characterized in that the carrier support (18) exposes a side opening (35) to the machine housing (11) between two mutually opposing intermediate walls (24, 26), in which opening (35) a pressure accumulator (36) coacting with the percussion motor (15) can be mounted.

13. A breaking hammer according to claim 4, characterized in that the carrier support (18) exposes a side opening (35) to the machine housing (11) between two mutually opposing intermediate walls (24, 26), in which opening (35) a pressure accumulator (36) coacting with the percussion motor (15) can be mounted.

14. A breaking hammer according to claim 5, characterized in that the carrier support (18) exposes a side opening (35) to the machine housing (11) between two mutually opposing intermediate walls (24, 26), in which opening (35) a pressure accumulator (36) coacting with the percussion motor (15) can be mounted.

15. A breaking hammer according to claim 4, characterized in that the machine housing (11) includes axially extending channels (44–46) around the percussion motor (15), of which channels two (44, 45) are connected to connector (39, 40) on the machine housing (11) for conducting hydraulic fluid to and from the percussion motor (15), and a third (46) of said channels functions to control the percussion motor (15); and in that the channels (44–46) are placed in hydraulic fluid connection with the percussion motor (15) such as to ensure a repetitive hammering sequence, through the medium of annular grooves (44′–46′) mutually grouped axially and mutually sealed in the guide passage (21), and radially extending channels (44″–46″) provided in the cylinder part (12) of the percussion motor (15) and connecting with said annular grooves (44′–46′).

16. A breaking hammer according to claim 6, characterized in that the machine housing (11) includes axially extending channels (44–46) around the percussion motor (15), of which channels two (44, 45) are connected to connector (39, 40) on the machine housing (11) for conducting hydraulic fluid to and from the percussion motor (15), and a third (46) of said channels functions to control the percussion motor (15); and in that the channels (44–46) are placed in hydraulic fluid connection with the percussion motor (15) such as to ensure a repetitive hammering sequence, through the medium of annular grooves (44′–46′) mutually grouped axially and mutually sealed in the guide passage (21), and radially extending channels (44″–46″) provided in the cylinder part (12) of the percussion motor (15) and connecting with said annular grooves (44′–46′).

* * * * *